US011811120B2

(12) United States Patent
Fiorese et al.

(10) Patent No.: US 11,811,120 B2
(45) **Date of Patent: *Nov. 7, 2023**

(54) WAVEGUIDE DEVICE METHOD FOR SEPARATING AND/OR COMBINING ORTHOGONALLY POLARIZED SIGNALS OF RADIOFREQUENCY WAVES

(71) Applicants: STMicroelectronics (Crolles 2) SAS, Crolles (FR); STMicroelectronics SA, Montrouge (FR)

(72) Inventors: Victor Fiorese, Crolles (FR); Frederic Gianesello, Saint Alban Leysse (FR); Florian Voineau, Niort (FR)

(73) Assignees: STMicroelectronics SA, Montrouge (FR); STMicroelectronics (Crolles 2) SAS, Crolles (FR)

( * ) Notice: Subject to any disclaimer, the term of this patent is extended or adjusted under 35 U.S.C. 154(b) by 17 days.

This patent is subject to a terminal disclaimer.

(21) Appl. No.: 17/646,964

(22) Filed: Jan. 4, 2022

(65) Prior Publication Data

US 2022/0131246 A1 Apr. 28, 2022

Related U.S. Application Data

(63) Continuation of application No. 16/901,832, filed on Jun. 15, 2020, now Pat. No. 11,258,148.

(30) Foreign Application Priority Data

Jun. 17, 2019 (FR) ..... 1906471

(51) Int. Cl.
*H01P 1/161* (2006.01)
*H01P 1/213* (2006.01)
(Continued)

(52) U.S. Cl.
CPC ..... *H01P 1/161* (2013.01); *H01P 1/2131* (2013.01); *H01P 5/19* (2013.01); *H01Q 25/001* (2013.01)

(58) Field of Classification Search
CPC ..... H01P 1/161; H01P 1/2131; H01P 5/19; H01Q 25/001
(Continued)

(56) References Cited

U.S. PATENT DOCUMENTS 11,258,148 B2 * 2/2022 Fiorese ..... H01P 5/19
2013/0314172 A1 11/2013 Massman
(Continued)

FOREIGN PATENT DOCUMENTS

CN 108011160 A 5/2018
JP 2015207863 A 11/2015
KR 100967153 B1 7/2010

*Primary Examiner* — Rakesh B Patel
*Assistant Examiner* — Jorge L Salazar, Jr.
(74) *Attorney, Agent, or Firm* — Slater Matsil, LLP

(57) ABSTRACT

An orthomode junction for separating and/or combining orthogonally-polarized radiofrequency wave signals, comprises a body which has a main cavity forming a main waveguide, which has a blind end, and auxiliary cavities forming auxiliary waveguides, which communicate laterally with the main cavity in the vicinity of the blind end thereof, and a deflection insert situated at the blind end of the main cavity and facing the auxiliary cavities, the deflection insert having different shapes on the side of the auxiliary cavities respectively.

20 Claims, 7 Drawing Sheets

(51) Int. Cl.
*H01P 5/19* (2006.01)
*H01Q 25/00* (2006.01)

(58) Field of Classification Search
USPC ..... 333/21 A, 126, 135
See application file for complete search history.

(56) References Cited

U.S. PATENT DOCUMENTS

2014/0266934 A1* 9/2014 Cook ..... H01Q 13/0208 343/720
2015/0295300 A1 10/2015 Herbsommer et al.

* cited by examiner

WAVEGUIDE DEVICE METHOD FOR SEPARATING AND/OR COMBINING ORTHOGONALLY POLARIZED SIGNALS OF RADIOFREQUENCY WAVES

CROSS-REFERENCE TO RELATED APPLICATIONS

This application is a continuation of U.S. patent application Ser. No. 16/901,832, filed Jun. 15, 2020, now U.S. Pat. No. 11,258,148, issued Feb. 22, 2022, which application claims the benefit of French Patent Application No. 1906471, filed on Jun. 17, 2019, all of which applications are hereby incorporated herein by reference.

TECHNICAL FIELD

The present invention relates to the field of the transmission (emission and/or reception) of radiofrequency waves.

BACKGROUND

More specifically, the field of transmission devices employing orthogonal polarization duplexers (also known as Orthogonal Mode Transducers, most commonly known by their abbreviation OMT) inserted between an electronic unit able to generate and/or to pick up radiofrequency signals, and an antenna, for example a parabolic antenna.

More specifically, polarization duplexers, or OMTs, are devices which are used to combine in emission mode or to separate in receive mode two orthogonally-polarized (one vertically and one horizontally) signals. Thus, it is possible to use the one same frequency band to emit and receive simultaneously distinct signals of which the electrical fields are mutually perpendicular.

Known polarization duplexers, or OMTs, comprise orthomode junctions for separating/combining orthogonally-polarized radiofrequency wave signals, which junctions are made in a body which has a main cavity forming a main waveguide, which has a blind end and an end generally coupled to an antenna, for example a parabolic antenna, and auxiliary cavities forming auxiliary waveguides, which have ends which communicate laterally with the main cavity in the vicinity of the blind end thereof, and ends which are coupled to an electronic unit. The adjacent parts of the main cavity that form a main waveguide, and of the auxiliary cavities that form auxiliary waveguides, are generally referred to as junctions.

Nevertheless, it is essential that, in emission and/or in reception, these junctions provide inter-polarization isolation between the two orthogonally-polarized signals so as to avoid exchanges of energy that would produce interference and noise detrimental to the communication.

SUMMARY

An embodiment orthomode junction for separating and/or combining orthogonally-polarized radiofrequency wave signals, comprises a body which has a main cavity forming a main waveguide, which has a blind end, and auxiliary cavities forming auxiliary waveguides, which communicate laterally with the main cavity in the vicinity of the blind end thereof, and a deflection insert situated at the blind end of the main cavity and facing the auxiliary cavities, the deflection insert having different shapes on the side of the auxiliary cavities respectively.

Thus, in emission and/or in reception, the inter-polarization isolation between the two orthogonally-polarized signals is improved.

The auxiliary cavities may communicate with the main cavity at opposing points.

The main cavity may comprise a main portion, adjacent to the blind end, of cylindrical cross section, and the auxiliary cavities may comprise auxiliary portions, adjacent to the cylindrical portion, of rectangular cross sections.

The axes of the rectangular auxiliary portions of the auxiliary cavities may intersect the axis of the cylindrical main portion of the main cavity orthogonally.

The rectangular auxiliary portions of the auxiliary cavities may be diametrically opposed with respect to the cylindrical main portion of the main cavity.

The long sides of one of the rectangular auxiliary portions may extend longitudinally with respect to the main cavity, and the long sides of the other rectangular auxiliary portion may extend orthogonally with respect to the main cavity.

The deflection insert may comprise parts which have opposing domed faces on the side of, or facing, the auxiliary cavities respectively.

One of the domed faces may be larger than the other domed face.

The deflection insert may comprise a projecting part which has opposing domed faces on the side of, or facing, the auxiliary cavities respectively.

The junction may be the result of manufacture by 3D printing.

BRIEF DESCRIPTION OF THE DRAWINGS

An orthomode junction for separating and/or combining orthogonally-polarized radiofrequency wave signals will now be described by way of non-limiting example, illustrated by the drawing in which.

DETAILED DESCRIPTION OF ILLUSTRATIVE EMBODIMENTS

Figure 1:
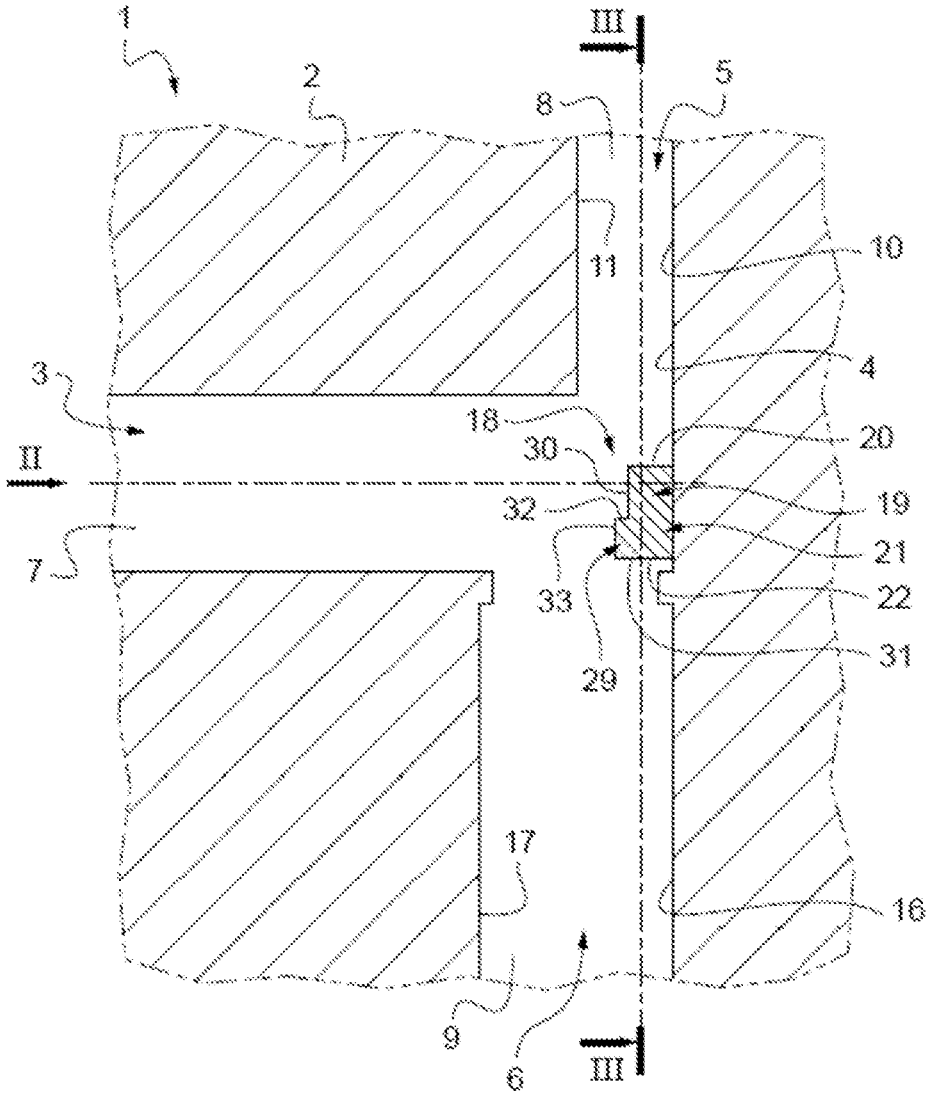
FIG. 1 depicts a partial longitudinal section through a junction.
Figure 2:
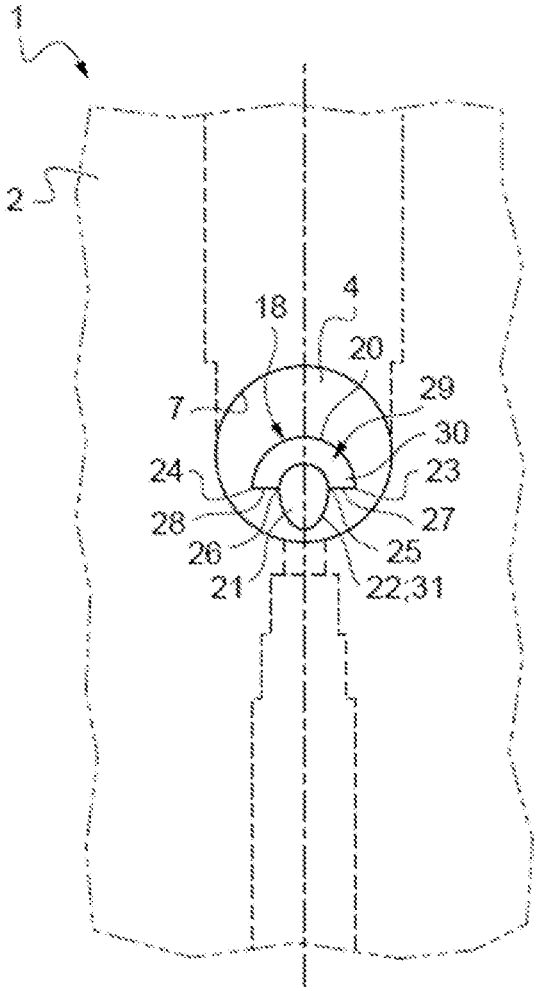
FIG. 2 depicts an axial view of the junction, in the direction of II-II of FIG. 1.
Figure 3:
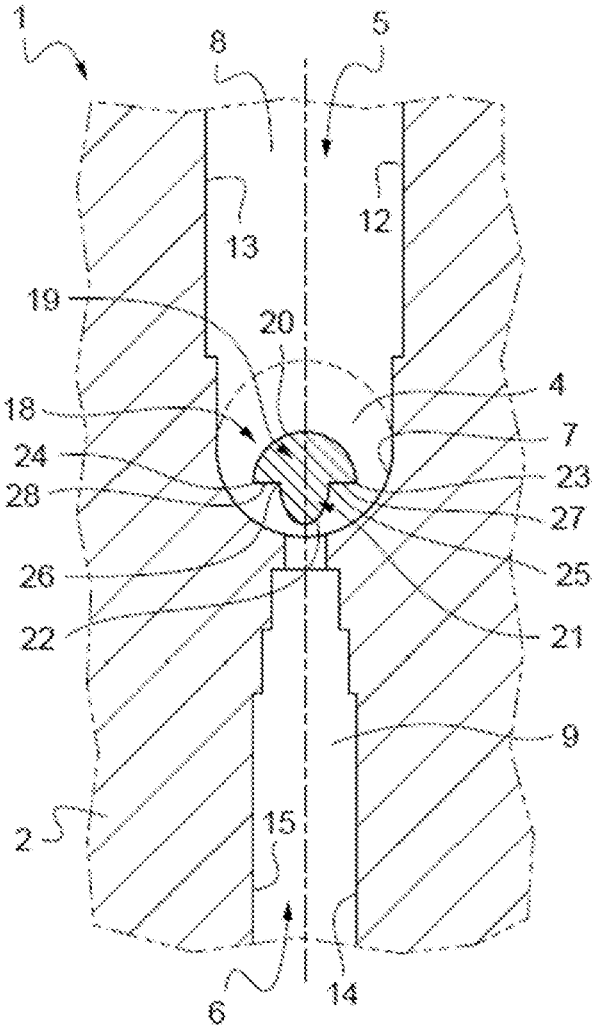
FIG. 3 depicts a partial radial section through the junction, on III-III of FIG. 1.
Figure 4:
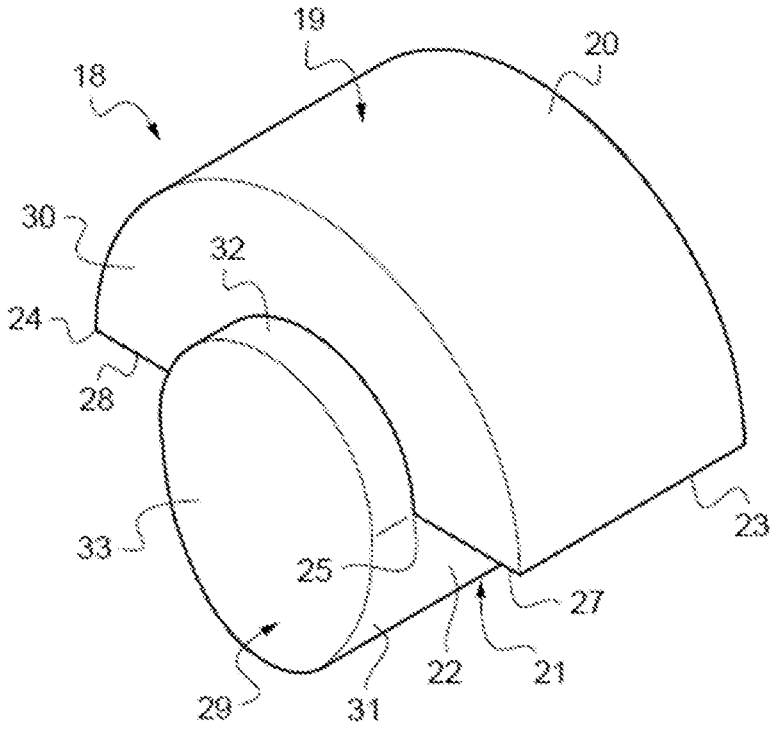
FIG. 4 depicts a perspective view of a deflection insert of the junction.

A junction 1, included in a polarization duplexer, or OMT, with a view to separating and/or combining orthogonally-polarized radiofrequency wave signals, comprises a body 2 in which there are formed a main cavity 3 that forms a main waveguide, which has a blind end 4, and auxiliary cavities 5 and 6 that form auxiliary waveguides, which communicate laterally with the main cavity 3 in the vicinity of the blind end 4 thereof.

More specifically, according to one alternative form of embodiment, the main cavity 3 comprises a main terminal portion 7, adjacent to the blind end 4, and of cylindrical cross section, the blind end 4 being arranged radially with respect to this cylindrical terminal portion 7.

The main end portion 7 is extended in the opposite direction to the radial blind end 4 by a junction portion, not depicted, which is routed, along a path of suitable shape, so that its terminal end is coupled to an antenna, for example a parabolic antenna, not depicted, able to emit and/or to pick up a radiofrequency wave.

The auxiliary cavities 5 and 6 comprise auxiliary terminal portions 8 and 9, of rectangular cross sections, which communicate radially with the main terminal portion 7 of the main cavity 3 in the vicinity of the radial blind end 4 and which are situated so that they are diametrically opposed with respect to the main terminal portion 7.

The auxiliary terminal portions 8 and 9 are extended in the opposite direction to the radial blind end 4 by a connecting portion, not depicted, and are routed, along paths of suitable shape, so that their terminal ends are coupled to distinct means able to emit and/or to pick up radiofrequency waves, belonging to an electronic unit, not depicted.

The auxiliary terminal portion 8 is situated in such a way that its axis intersects the axis of the main terminal portion 7 at right angles, that its opposite long sides 10 and 11 are situated radially with respect to the main terminal portion 7, that its opposite short sides 12 and 13 are situated longitudinally with respect to the main terminal portion 7, and that the distance between its opposite short sides 12 and 13 is equal to the diameter of the main terminal portion 7 so as to meet the latter tangentially.

The auxiliary terminal portion 9 is situated in such a way that its axis intersects the axis of the main terminal portion 7 at right angles, that its opposite long sides 14 and 15 are situated longitudinally with respect to the main terminal portion 7, that its opposite short sides 16 and 17 are situated radially with respect to the main terminal portion 7, and that the distance between its opposite long sides 14 and 15 is less than the diameter of the main terminal portion 7.

The junction 1 is configured in such a way as to operate as follows.

In receive mode, a radiofrequency wave including orthogonally-polarized signals, for example coming from the aforementioned antenna, is routed in the main cavity 3 towards the blind end 4.

From the main terminal portion 7 of the main cavity 3, this radiofrequency wave is split, heading towards the auxiliary cavities 5 and 6, into two radiofrequency waves respectively including the orthogonally-polarized signals.

These separated radiofrequency waves enter the terminal portions 8 and 9 of the auxiliary cavities 5 and 6 and are then routed through the auxiliary cavities 5 and 6 towards the aforementioned pick-up means of the aforementioned electronic unit. The electronic unit therefore processes the received signals separately.

Reciprocally, in emit mode, the aforementioned emission means of the aforementioned electronic unit emit radiofrequency waves respectively including distinct orthogonally-polarized signals, into the auxiliary cavities 5 and 6 respectively.

The radiofrequency waves are routed through the auxiliary cavities 5 and 6, passed through the terminal portions 8 and 9 and then enter the terminal portion 7 of the main cavity 3. Therefore, the radiofrequency waves coming from the auxiliary cavities 5 and 6 combine to form a resultant radiofrequency wave including the distinct orthogonally-polarized signals.

This resultant radiofrequency wave is then routed through the main cavity 3 away from the radial end 4, as far as the aforementioned antenna.

In a two-way communication mode, one of the two electronic units emits radiofrequency waves while the second electronic unit receives radiofrequency waves in the same frequency band but with orthogonal polarization. The wave emitted by the emitting electronic unit travels through the structure as described hereinabove. At the same time, the signal picked up by the receiving other electronic unit, and which comes from the antenna, travels through the structure in the opposite direction with an orthogonal polarization mode, as described hereinabove.

It is evident from the foregoing that the junction 1 is able to combine in one direction of traffic and to separate in the other direction of traffic, on the one same frequency band, distinct signals, the electric fields of which are mutually perpendicular.

The junction 1 further comprises a deflection insert 18 which is situated to project with respect to the blind end 4 of the main cavity 3 and facing the auxiliary cavities 8 and 9 so as to facilitate the separating and/or the combining of the orthogonally-polarized signals.

Advantageously, the deflection insert 18 has different shapes respectively facing or on the side of the auxiliary cavities 5 and 6. The face of the deflection insert 18 has, on the opposite side to the radial end 4, a shape that is discontinuous.

According to one exemplary embodiment, the deflection insert 18 is configured as follows.

The deflection insert 18 is placed against the radial end 4 of the terminal portion 7 of the main cavity 3 and comprises a part 19 which, on the side of the auxiliary cavity 5, has a domed face 20 the generatrices of which extend parallel to the axis of the terminal portion 7, and a part 21 which, on the side of the auxiliary cavity 6, has a domed face 22 the generatrices of which extend parallel to the axis of the terminal portion 7, the faces 20 and 22 being opposed and domed in opposite directions.

Perpendicular to the parallel axes of the terminal portions 8 and 9 of the auxiliary cavities 5 and 6, the domed face 20 is, between the terminal generatrices 23 and 24, larger than the domed face 22, between the terminal generatrices 25 and 26. The face 20 is not as domed as the face 22.

The part 19 has flat faces 27 and 28 which respectively join the terminal generatrices 23 and 24 and the terminal generatrices 25 and 26 and which are situated on either side of the part 21 and on the side of the auxiliary cavity 6. The flat faces 27 and 28 are in the one same plane which is perpendicular to the axes of the terminal portions 8 and 9 of the auxiliary cavities 5 and 6.

For example, the domed faces 20 and 22 have cross sections in the form of portions of circles or of ellipses.

The deflection insert 18 further comprises, on the opposite side to the radial end 4, a part 29 that projects with respect to a radial end face 30 of the part 19. The projecting part 29 has, on the side of the auxiliary cavity 6, a domed face 31 which extends the domed face 22 and, on the side of the auxiliary cavity 5, a domed face 32 which extends from the radial face 30 of the part 19, the domed faces 31 and 32 meeting in the continuation of the generatrices 25 and 26. The projecting part 29 has a radial end face 33.

According to an alternative form of embodiment, the edge corners of the deflection insert 18 could be chamfered.

The deflection insert 18 is offset towards the auxiliary cavity 6 with respect to the axis of the main portion 7 of the main cavity 3.

According to an alternative form of manufacture, the body 2 of the junction 1 may comprise several assembled parts, the deflection insert 18 being added at the moment of assembly.

According to another alternative form of manufacture, the body 2 of the junction 1 may be obtained directly using a 3D printing system.

Figure 5:
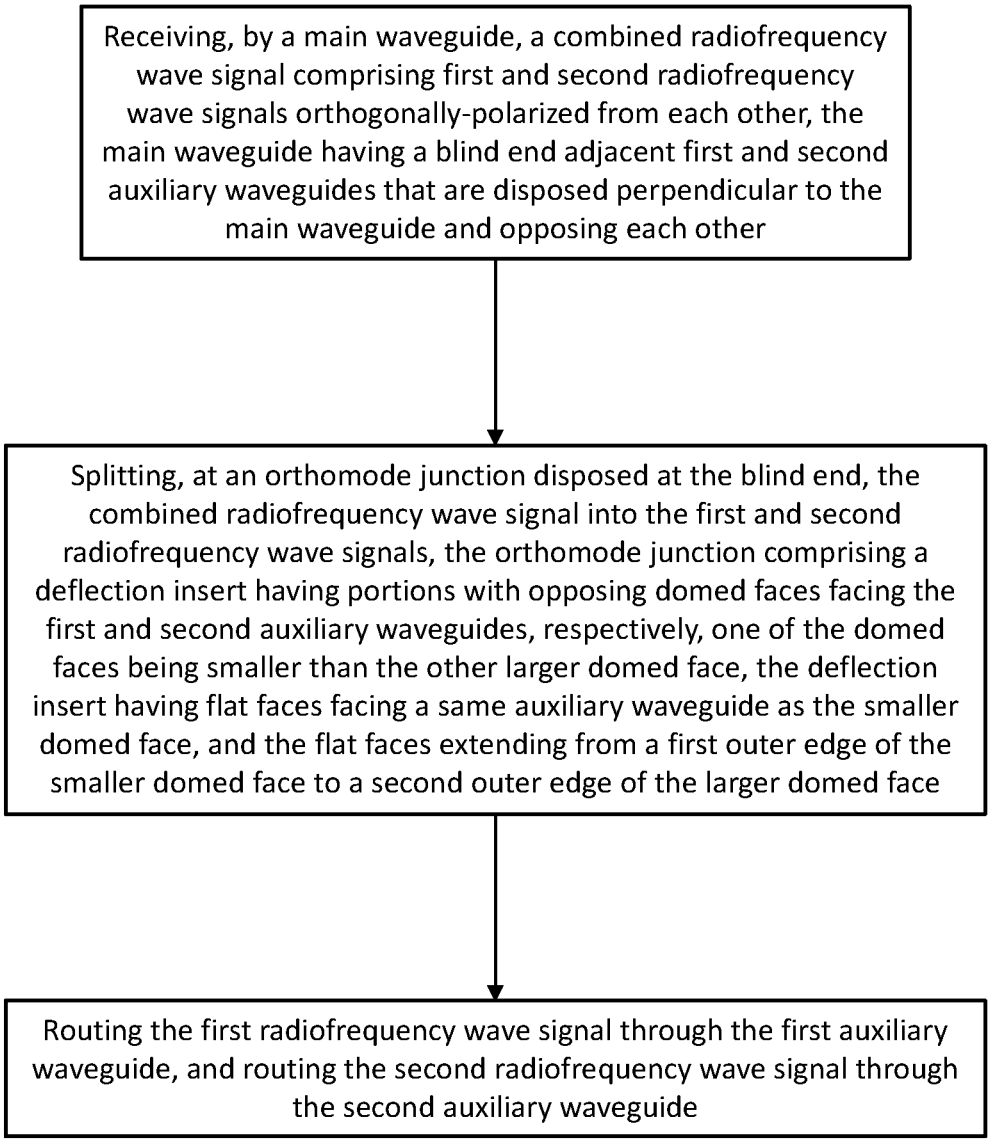
FIG. 5 depicts a method of operating a waveguide device to split a combined radiofrequency wave signal into two orthogonally polarized radiofrequency wave signals.

FIG. 5 depicts a method of operating a waveguide device to split a combined radiofrequency wave signal into two orthogonally polarized radiofrequency wave signals. The method includes receiving, by a main waveguide, a combined radiofrequency wave signal comprising first and second radiofrequency wave signals orthogonally-polarized from each other, the main waveguide having a blind end adjacent first and second auxiliary waveguides that are disposed perpendicular to the main waveguide and opposing each other. The method also includes splitting, at an orthomode junction disposed at the blind end, the combined radiofrequency wave signal into the first and second radiofrequency wave signals, the orthomode junction comprising a deflection insert having portions with opposing domed faces facing the first and second auxiliary waveguides, respectively, one of the domed faces being smaller than the other larger domed face, the deflection insert having flat faces facing a same auxiliary waveguide as the smaller domed face, and the flat faces extending from a first outer edge of the smaller domed face to a second outer edge of the larger domed face. The method further includes routing the first radiofrequency wave signal through the first auxiliary waveguide, and routing the second radiofrequency wave signal through the second auxiliary waveguide.

Figure 6:
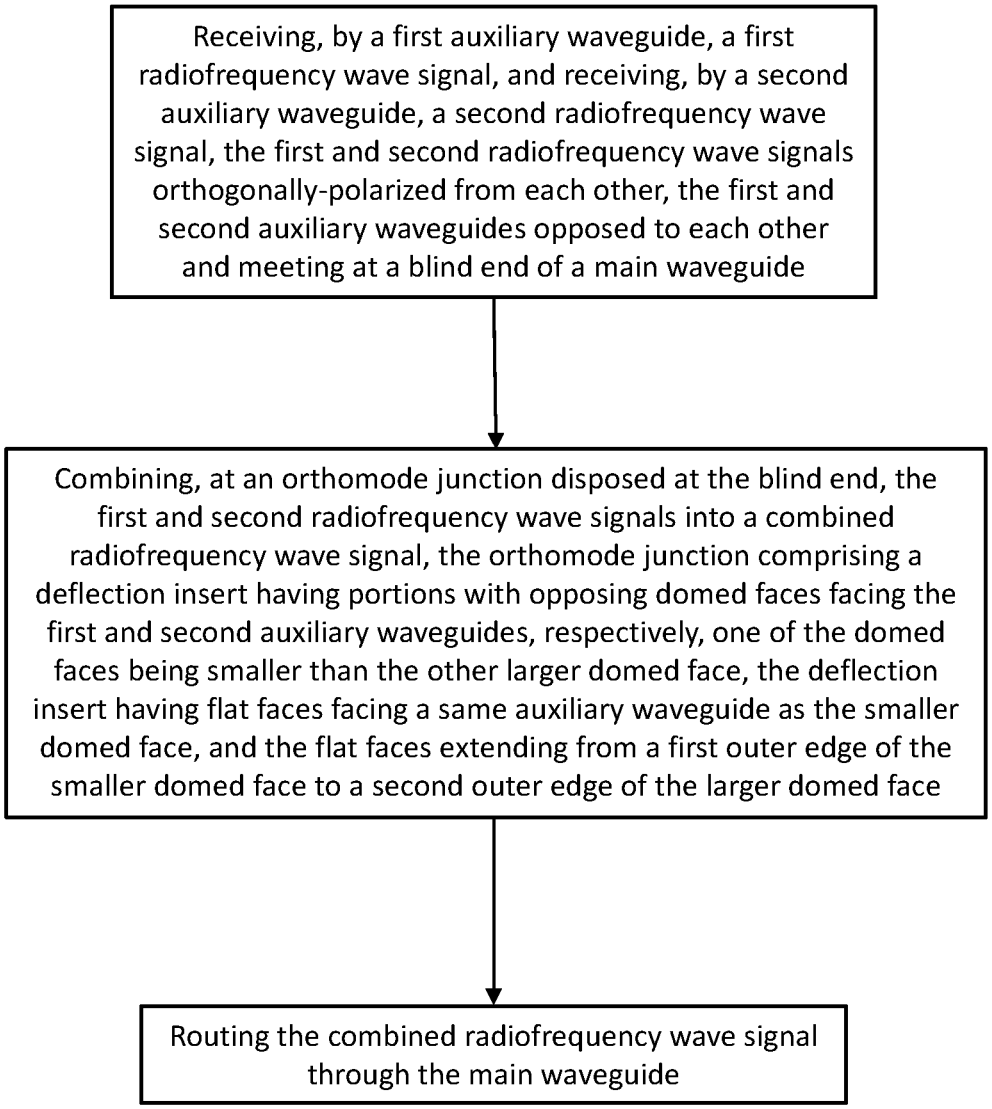
FIG. 6 depicts a method of operating a waveguide device to combine two orthogonally polarized radiofrequency wave signals into a combined radiofrequency wave signal.

FIG. 6 depicts a method of operating a waveguide device to combine two orthogonally polarized radiofrequency wave signals into a combined radiofrequency wave signal. The method includes receiving, by a first auxiliary waveguide, a first radiofrequency wave signal. The method also includes receiving, by a second auxiliary waveguide, a second radiofrequency wave signal, the first and second radiofrequency wave signals orthogonally-polarized from each other, the first and second auxiliary waveguides opposed to each other and meeting at a blind end of a main waveguide. The method further includes combining, at an orthomode junction disposed at the blind end, the first and second radiofrequency wave signals into a combined radiofrequency wave signal, the orthomode junction comprising a deflection insert having portions with opposing domed faces facing the first and second auxiliary waveguides, respectively, one of the domed faces being smaller than the other larger domed face, the deflection insert having flat faces facing a same auxiliary waveguide as the smaller domed face, and the flat faces extending from a first outer edge of the smaller domed face to a second outer edge of the larger domed face. The method includes routing the combined radiofrequency wave signal through the main waveguide.

Figure 7:
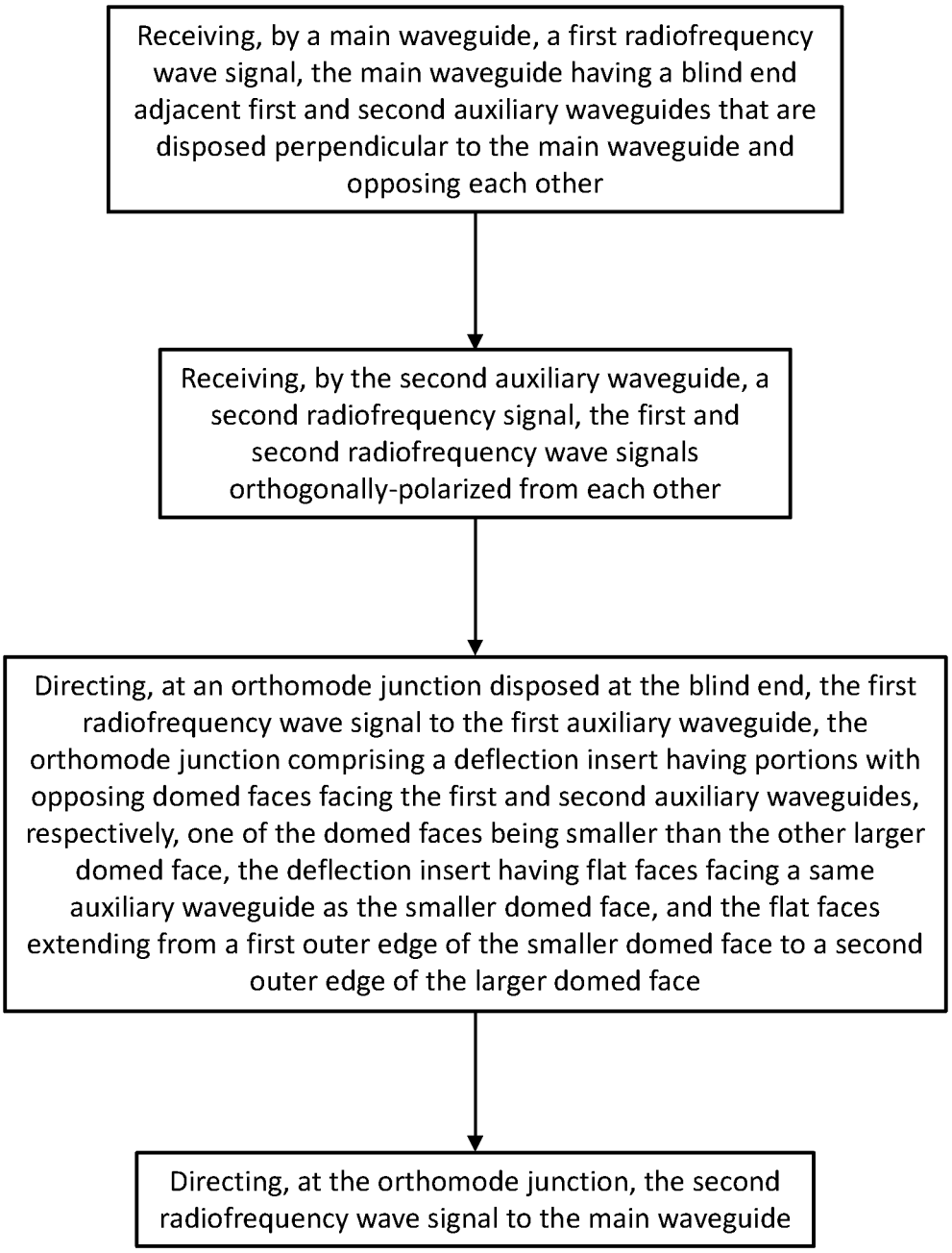
FIG. 7 depicts a method of operating a waveguide device to receive a radiofrequency wave signal in one direction while sending another orthogonally polarized radiofrequency wave signal in the opposite direction.

FIG. 7 depicts a method of operating a waveguide device to receive a radiofrequency wave signal in one direction while sending another orthogonally polarized radiofrequency wave signal in the opposite direction. The method includes receiving, by a main waveguide, a first radiofrequency wave signal, the main waveguide having a blind end adjacent first and second auxiliary waveguides that are disposed perpendicular to the main waveguide and opposing each other. The method also includes receiving, by the second auxiliary waveguide, a second radiofrequency signal, the first and second radiofrequency wave signals orthogonally-polarized from each other. The method further includes directing, at an orthomode junction disposed at the blind end, the first radiofrequency wave signal to the first auxiliary waveguide, the orthomode junction comprising a deflection insert having portions with opposing domed faces facing the first and second auxiliary waveguides, respectively, one of the domed faces being smaller than the other larger domed face, the deflection insert having flat faces facing a same auxiliary waveguide as the smaller domed face, and the flat faces extending from a first outer edge of the smaller domed face to a second outer edge of the larger domed face. The method includes directing, at the orthomode junction, the second radiofrequency wave signal to the main waveguide.

What is claimed is:

1. A method of operating a waveguide device, the method comprising:

receiving, by a main waveguide, a combined radiofrequency wave signal comprising first and second radiofrequency wave signals orthogonally-polarized from each other, the main waveguide having a blind end adjacent first and second auxiliary waveguides that are disposed perpendicular to the main waveguide and opposing each other;

splitting, at an orthomode junction disposed at the blind end, the combined radiofrequency wave signal into the first and second radiofrequency wave signals, the orthomode junction comprising a deflection insert having portions with opposing domed faces facing the first and second auxiliary waveguides, respectively, one of the domed faces being smaller than the other larger domed face, the deflection insert having flat faces facing a same auxiliary waveguide as the smaller domed face, and the flat faces extending from a first outer edge of the smaller domed face to a second outer edge of the larger domed face;

routing the first radiofrequency wave signal through the first auxiliary waveguide; and routing the second radiofrequency wave signal through the second auxiliary waveguide.

2. The method according to claim 1, wherein the first and second radiofrequency wave signals have a same frequency.

3. The method according to claim 1, further comprising receiving, by the main waveguide, the combined radiofrequency wave signal from an antenna.

4. The method according to claim 3, further comprising:

providing, by the first auxiliary waveguide, the first radiofrequency wave signal to an electronic unit; and providing, by the second auxiliary waveguide, the second radiofrequency wave signal to the electronic unit.

5. The method according to claim 1, wherein the larger domed face is symmetrically cylindrical, and the smaller domed face is asymmetrically cylindrical.

6. The method according to claim 1, wherein the larger domed face has a consistent radius, and the smaller domed face has a varying radius.

7. The method according to claim 1, wherein the deflection insert further comprises a projecting portion having second opposing domed faces facing the two auxiliary waveguides, respectively.

8. A method of operating a waveguide device, the method comprising:

receiving, by a first auxiliary waveguide, a first radiofrequency wave signal;

receiving, by a second auxiliary waveguide, a second radiofrequency wave signal, the first and second radiofrequency wave signals orthogonally-polarized from each other, the first and second auxiliary waveguides opposed to each other and meeting at a blind end of a main waveguide;

combining, at an orthomode junction disposed at the blind end, the first and second radiofrequency wave signals into a combined radiofrequency wave signal, the orthomode junction comprising a deflection insert having portions with opposing domed faces facing the first and second auxiliary waveguides, respectively, one of the domed faces being smaller than the other larger domed face, the deflection insert having flat faces facing a same auxiliary waveguide as the smaller domed face, and the flat faces extending from a first outer edge of the smaller domed face to a second outer edge of the larger domed face; and routing the combined radiofrequency wave signal through the main waveguide.

9. The method according to of claim 8, wherein the first and second radiofrequency wave signals have a same frequency.

10. The method according to claim 8, further comprising:

receiving, by the first auxiliary waveguide, the first radiofrequency wave signal from an electronic unit; and receiving, by the second auxiliary waveguide, the second radiofrequency wave signal from the electronic unit.

11. The method according to claim 10, further comprising providing, by the main waveguide, the combined radiofrequency wave signal to an antenna.

12. The method according to claim 8, wherein the larger domed face is symmetrically cylindrical, and the smaller domed face is asymmetrically cylindrical.

13. The method according to claim 8, wherein the larger domed face has a consistent radius, and the smaller domed face has a varying radius.

14. The method according to claim 8, wherein the deflection insert further comprises a projecting portion having second opposing domed faces facing the two auxiliary waveguides, respectively.

15. A method of operating a waveguide device, the method comprising:

receiving, by a main waveguide, a first radiofrequency wave signal, the main waveguide having a blind end adjacent first and second auxiliary waveguides that are disposed perpendicular to the main waveguide and opposing each other;

receiving, by the second auxiliary waveguide, a second radiofrequency signal, the first and second radiofrequency wave signals orthogonally-polarized from each other;

directing, at an orthomode junction disposed at the blind end, the first radiofrequency wave signal to the first auxiliary waveguide, the orthomode junction comprising a deflection insert having portions with opposing domed faces facing the first and second auxiliary waveguides, respectively, one of the domed faces being smaller than the other larger domed face, the deflection insert having flat faces facing a same auxiliary waveguide as the smaller domed face, and the flat faces extending from a first outer edge of the smaller domed face to a second outer edge of the larger domed face; and directing, at the orthomode junction, the second radiofrequency wave signal to the main waveguide.

16. The method according to claim 15, wherein the first and second radiofrequency wave signals have a same frequency.

17. The method according to claim 15, further comprising:

receiving, by the main waveguide, the first radiofrequency wave signal from an antenna; and providing, by the first auxiliary waveguide, the first radiofrequency wave signal to a first electronic unit.

18. The method according to claim 17, further comprising:

receiving, by the second auxiliary waveguide, the second radiofrequency wave signal from a second electronic unit; and providing, by the main waveguide, the second radiofrequency wave signal to the antenna.

19. The method according to claim 15, wherein the larger domed face is symmetrically cylindrical, and the smaller domed face is asymmetrically cylindrical.

20. The method according to claim 15, wherein the larger domed face has a consistent radius, and the smaller domed face has a varying radius.

* * * * *